US006352256B1

(12) United States Patent
Hsieh

(10) Patent No.: US 6,352,256 B1
(45) Date of Patent: Mar. 5, 2002

(54) MEDIA FEEDING SYSTEM

(75) Inventor: Yen-Sung Hsieh, Taipei (TW)

(73) Assignee: Acer Communications and Multimedia Inc., Neihu (TW)

( * ) Notice: Subject to any disclaimer, the term of this patent is extended or adjusted under 35 U.S.C. 154(b) by 21 days.

(21) Appl. No.: 09/614,567

(22) Filed: Jul. 12, 2000

(51) Int. Cl.[7] ..... B65H 7/08
(52) U.S. Cl. ..... 271/110; 271/117; 271/121
(58) Field of Search ..... 271/110, 114, 271/117, 118, 121, 124

(56) References Cited

U.S. PATENT DOCUMENTS 5,547,181 A * 8/1996 Underwood ..... 271/114
5,971,390 A * 10/1999 Caspar et al. ..... 271/121
6,024,356 A * 2/2000 Tanaka et al. ..... 271/10.13
6,139,007 A * 10/2000 Cahill et al. ..... 271/121
6,206,367 B1 * 3/2001 Jo ..... 271/264

* cited by examiner

*Primary Examiner*—David H. Bollinger
(74) *Attorney, Agent, or Firm*—Winston Hsu

(57) ABSTRACT

A media feeding system has a pick arm with a pick roller, a media tray, a media restrainer, a motor and a drive train. The pick arm is rotatably installed above the media tray so that it can lift the pick roller away from the media tray, and lower it onto the media tray. The media restrainer can be in an up or a down position. When in the up position, it prevents media from moving out of the media tray. When in the down position, media can move out of the media tray past the media restrainer. The drive train delivers torque from the motor to the pick arm, pick roller and media restrainer. The motor can operate in two directions. When operating in the first direction, the media restrainer moves into the down position, the pick roller lowers onto stacked media and pushes a sheet out of the media tray past the media restrainer. When the motor operates in the second direction, the media restrainer moves into the up position, and the pick arm lifts the pick roller away from the stacked media.

20 Claims, 7 Drawing Sheets

MEDIA FEEDING SYSTEM

BACKGROUND OF THE INVENTION

1. Field of the Invention

The present invention relates to a media feeding system. More specifically, a media feeding system with a rotating pick arm and a rotating media restrainer is disclosed.

2. Description of the Prior Art

Media feeding systems are used to deliver media to a device, such as a fax machine, scanner, copier, printer, etc. The media is usually sheets of paper, but can also include plastic for transparencies, film, envelopes, etc. The media is typically stacked, and the media feeding system pulls the top sheet from the stack and delivers it to the device. Media feeding systems typically involve a so-called pick roller, which is a wheel that uses friction to push the top sheet or sheets from the stacked media, and a media separator. The media separator ensures that only a single sheet at a time is delivered on to the device, i.e., that only a single sheet of paper is fed into a printer.

Please refer to FIG. 1. FIG. 1 is a perspective view of a prior art media feeding system 10 for a printer, as disclosed in U.S. Pat. No. 5,971,390. Briefly, the media feeding system 10 comprises a media tray 12, a pick assembly 14 and a media separator 16. The pick assembly 14 comprises a pick roller 18, which pushes a sheet from the media tray 12 towards the media separator 16. The media separator 16 is a pad with a high coefficient of friction. When two sheets are pushed by the pick roller 18 past the media separator 16, the bottom sheet is stopped by the friction pad, and the top sheet slides over the bottom sheet to continue on towards the printer. In this manner, only a single sheet of media, such as paper, is fed into the printer.

The pick assembly 14 also comprises a spring (not shown), or some other such element, to provide a torque that pushes the pick roller 18 down onto the stacked media. This ensures that a sufficient amount of frictional force is available between the sheet and the pick roller 18 to push the sheet of media forward towards the printer, past the media separator 16. Although this torque is necessary, it can be a source of inconvenience when a user attempts to load the media tray. Consider, for example, particularly flimsy media, such as paper with a poor weight, or very thin paper. When the user grabs a few sheets and attempts to push them into the media tray 12, rather than sliding under the pick roller 18, the paper will bow. The user must manually lift up the pick assembly to insert the paper. Furthermore, when the paper moves into a following feed roller, it will still be in contact with the pick roller, and the friction between the pick roller and the paper can cause a reduction in printing quality.

SUMMARY OF THE INVENTION

It is therefore a primary objective of this invention to provide a media feeding system that has a pick roller that automatically rotates up when not feeding media, thus making it easier for a user to load a media tray of the media feeding system.

The present invention, briefly summarized, discloses a media feeding system that comprises a pick arm, one end of the pick arm having a pick roller, a media tray, a media restrainer, a motor and a drive train. The pick arm is rotatably installed above the media tray so that it can lift the pick roller up away from stacked media in the media tray, and lower it down onto the stacked media. The media restrainer can be in an up or a down position. When in the up position, it prevents the media from moving out of the media tray. When in the down position, media can move out of the media tray past the media restrainer. The drive train delivers torque from the motor to the pick arm, the pick roller and the media restrainer. The motor can operate in two directions. When operating in the first direction, the media restrainer moves into the down position, the pick roller lowers onto the stacked media and pushes a sheet out of the media tray past the media restrainer. When the motor operates in the second direction, the media restrainer moves into the up position, and the pick arm lifts the pick roller away from the stacked media.

It is an advantage of the present invention that the pick arm pulls the pick roller away from the stacked media when the media feeding system is not feeding the media to a device. Hence, it is easier for a user to load the media into the media tray. Additionally, as the pick roller is not in contact with the media when the media moves on to a following feed roller, printing quality can be improved.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
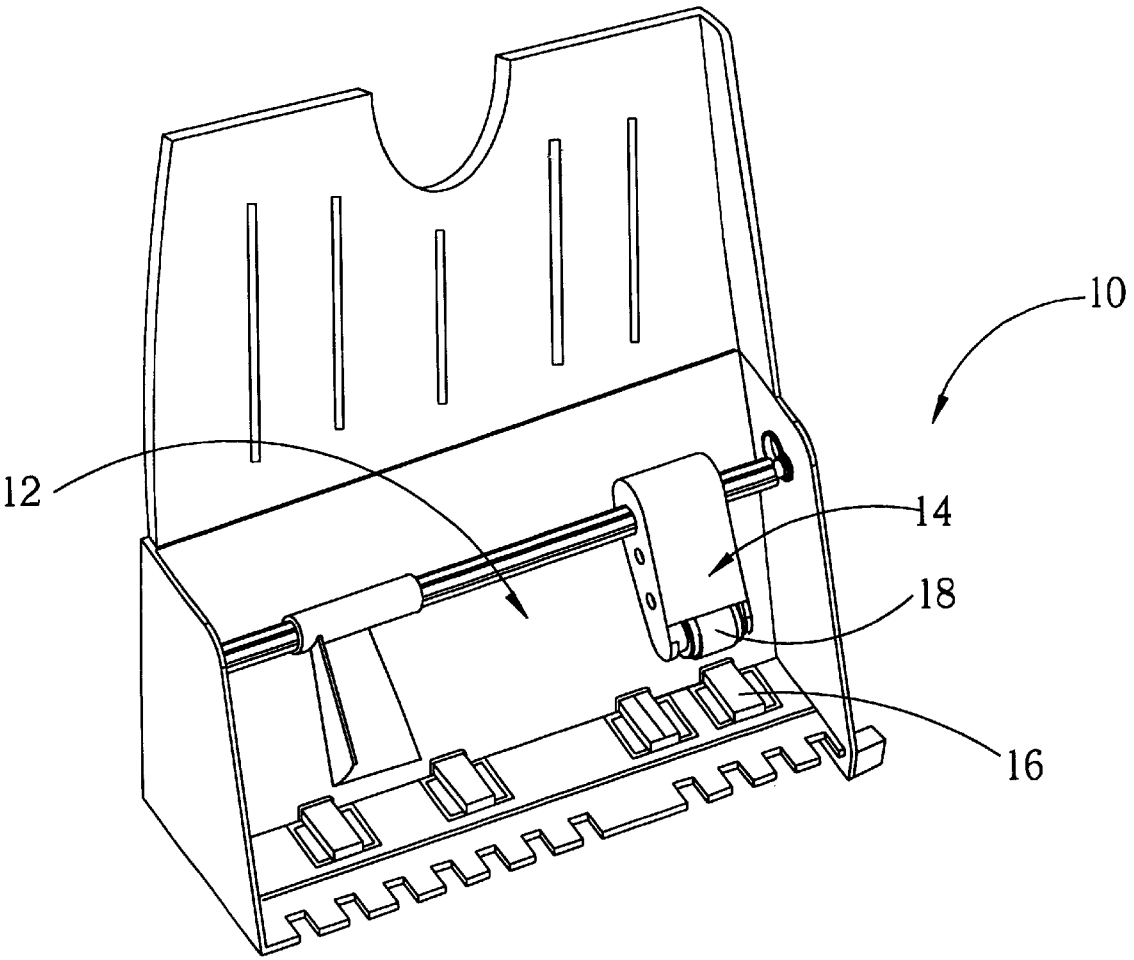
Fig. 1 Prior art
FIG. 1 is a perspective view of a prior art media feeding system.
Figure 2:
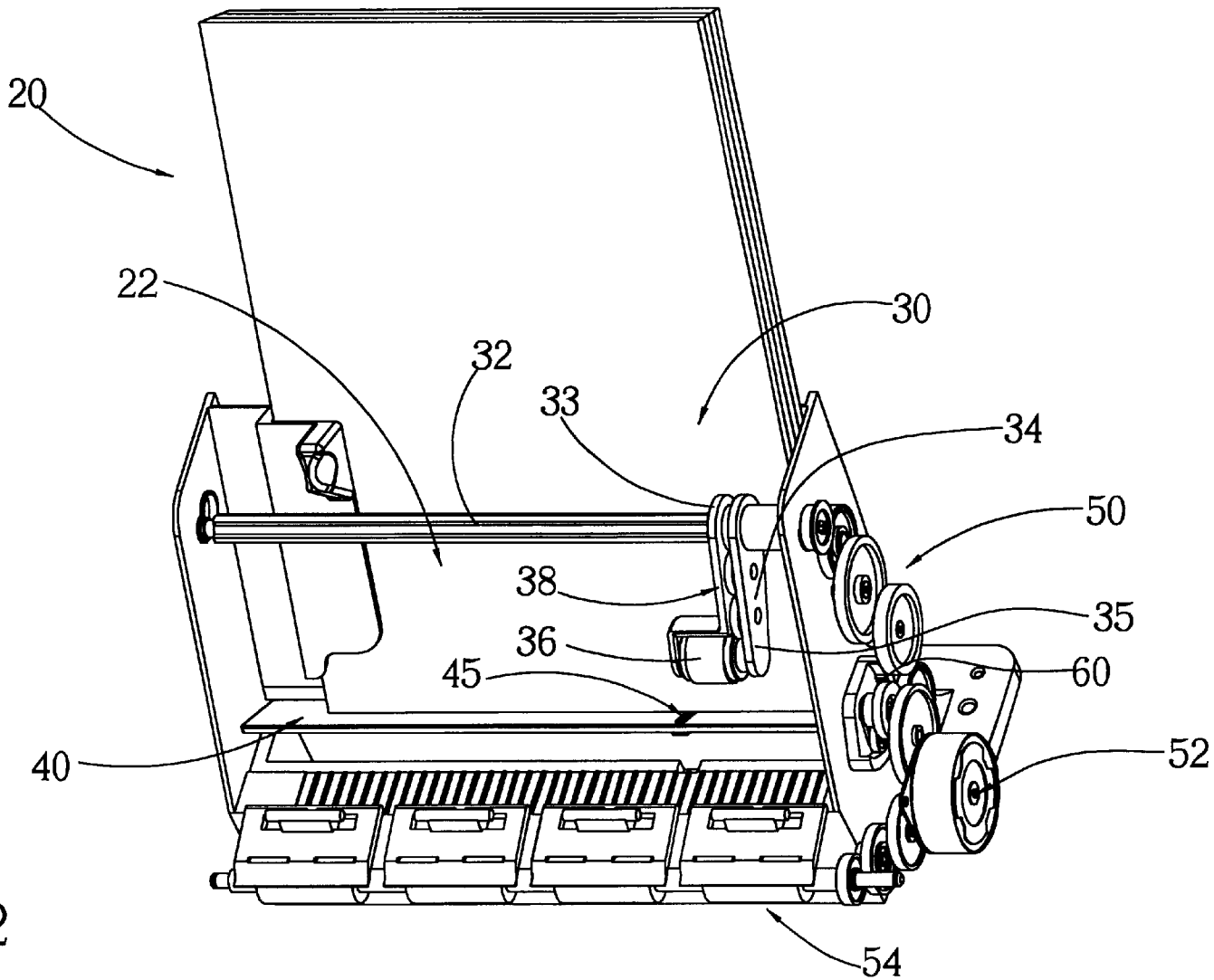
FIG. 2 is a perspective view diagram of a preferred embodiment of a present invention media feeding system.

Please refer to FIG. 2. FIG. 2 is a perspective view diagram of a preferred embodiment of the present invention media feeding system 20. The media feeding system 20 comprises a media tray 22, a pick unit 30, a media restrainer 40, a media separator 45, a drive train 50, a motor 52, and a feed roller 54.

The pick unit 30 comprises a pick shaft 32, a pick arm 34, and a pick roller 36, and is used to pick a sheet from the media tray 22. The pick shaft 32 is rotatably mounted over the media tray 22. The pick arm 34 has a rotation pivot 33 on one end and a pick pivot 35 on the other end. The pick roller 36 is rotatably mounted on the pick arm 34 at the pick pivot 35. The pick pivot 35 rotates about the rotation pivot 33 over the media tray 22, and in this manner the pick roller 36 is lifted up away from the media tray 22, or is lowered down onto the media tray 22.

The drive train 50 engagingly connects the motor 52 to the pick shaft 32, the media restrainer 40 and the feed roller 54. According to this preferred embodiment, the drive train 50 uses a series of interconnected gears to deliver torque from the motor 52 to the mentioned units. In order to deliver rotational energy to the pick roller 36, a pick arm assembly 38 engages the pick shaft 32 with the pick roller 36. The pick arm assembly 38 of the preferred embodiment comprises, like the drive train 50, an appropriate combination of interconnected gears to deliver the proper rotational speed and direction to the pick roller 36 from the pick shaft 32.

Figure 3:
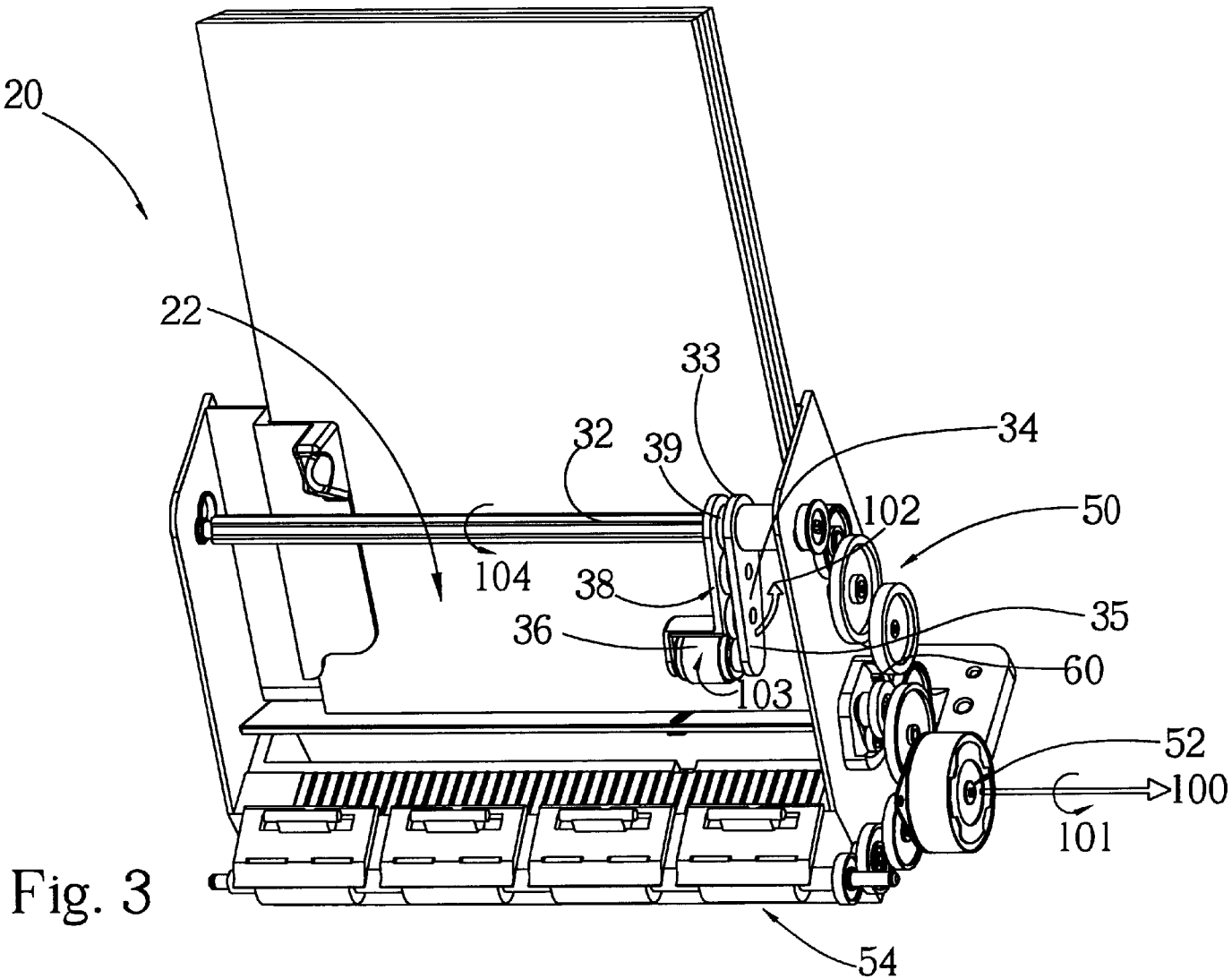
FIG. 3 is a perspective diagram of the media feeding system of FIG. 2 when a motor rotates in a first driving direction.

Please refer to FIG. 3. FIG. 3. is a perspective diagram of the media feeding system 20 of FIG. 2 when the motor 52 rotates in a first driving direction. The first driving direction is indicated by arrow 101 around a motor axis arrow 100. The rotational energy of the motor 52 is delivered by the drive train 50 to the pick shaft 32, causing it to rotate in a direction indicated by arrow 104. Because the pick arm 34 is mounted onto the pick shaft 32, the rotation 104 of the pick shaft 32 causes the pick pivot 35 to swing down towards the media tray 22, as indicated by arrow 102. In order to prevent the entire drive train 50 from seizing once the pick roller 36 contacts media in the media tray 22, which limits the swing of the pick arm 34, a torque limiter 39 is used to connect the rotation pivot 33 of the pick arm 34 to the pick shaft 32. Once torque delivered to the torque limiter 39 exceeds a certain value, the torque limiter 39 will slip, thus permitting the motor 52 to continue driving the drive train 50. The rotation 104 of the pick shaft 32 is delivered to the pick roller 36 via the pick arm assembly 38. The configuration of the pick arm assembly 38 is such that the rotation 104 of the pick shaft 32 translates into a rotation 103 of appropriate speed for the pick roller 36. When in contact with a sheet of media, the rotation 103 of the pick roller 36 pushes the sheet, or possibly more than one sheet, in a forward direction towards the feed roller 54.

Figure 4:
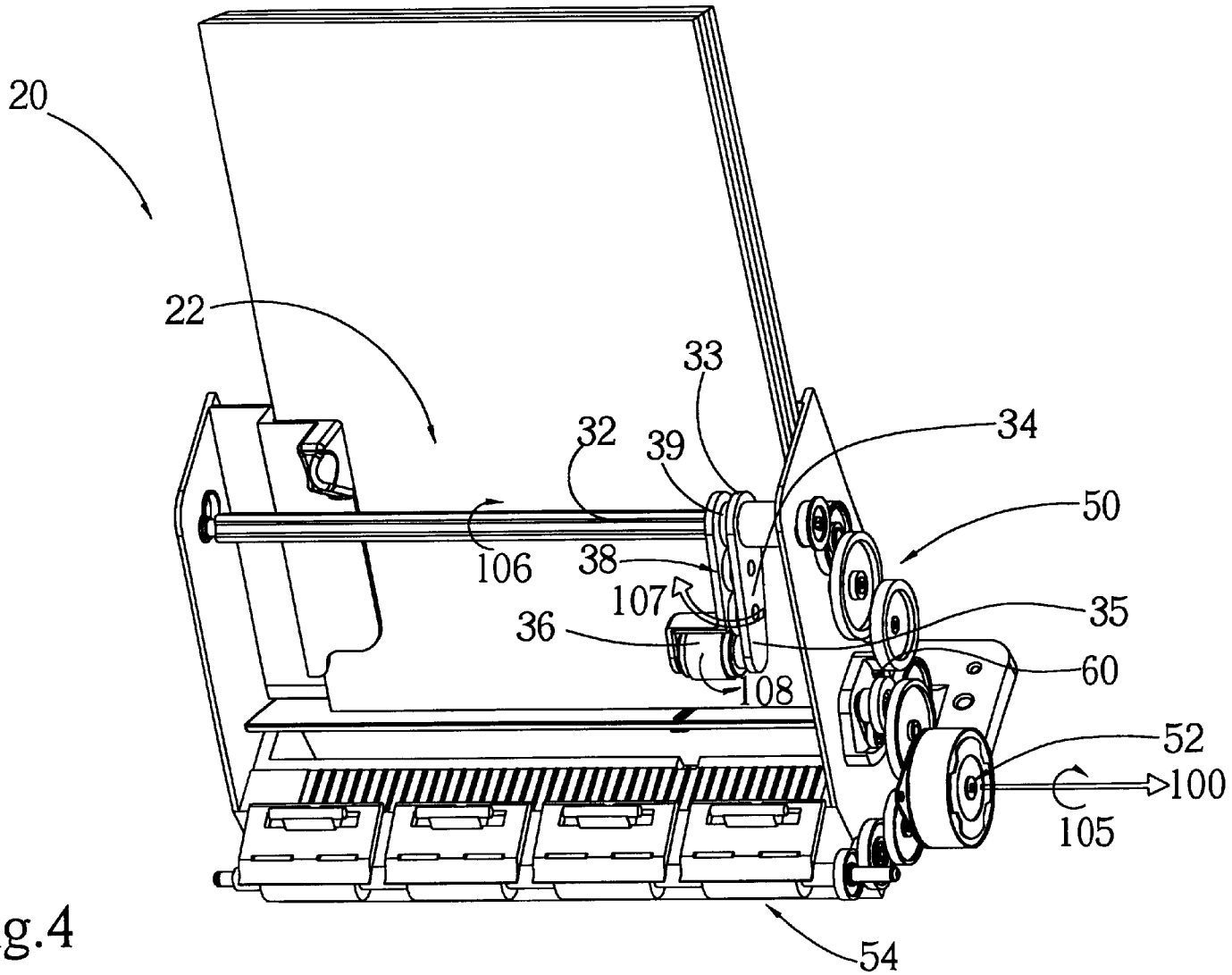
FIG. 4 is a perspective diagram of the media feeding system of FIG. 2 when a motor rotates in a second driving direction.

Please refer to FIG. 4. FIG. 4 is a perspective diagram of the media feeding system 20 of FIG. 2 when the motor 52 rotates in a second driving direction. Arrow 105 around the motor axis arrow 100 indicates the second driving direction. The second driving direction 105 causes a rotation 106 of the pick shaft 32, which, in turn, lifts the pick pivot 35 away from the media tray 22 in a direction indicated by arrow 107. Consequently, though the pick arm assembly 38 causes the pick roller 36 to rotate in a direction 108 that would tend to push a sheet of media in a backwards direction away from the feed roller 54, the pick roller 36 is unable to do so as it is not in contact with the stacked media. Another swing limit is also imposed upon the pick arm 34 to prevent the pick arm 34 from swinging completely around the pick shaft 32, and thus preventing it from coming into contact with the stacked media on the opposite side of the pick shaft 32. As mentioned, the torque limiter 39 ensures that the motor 52 can continue to drive the drive train 50 when the pick arm 34 reaches this swing limit.

Figure 5:
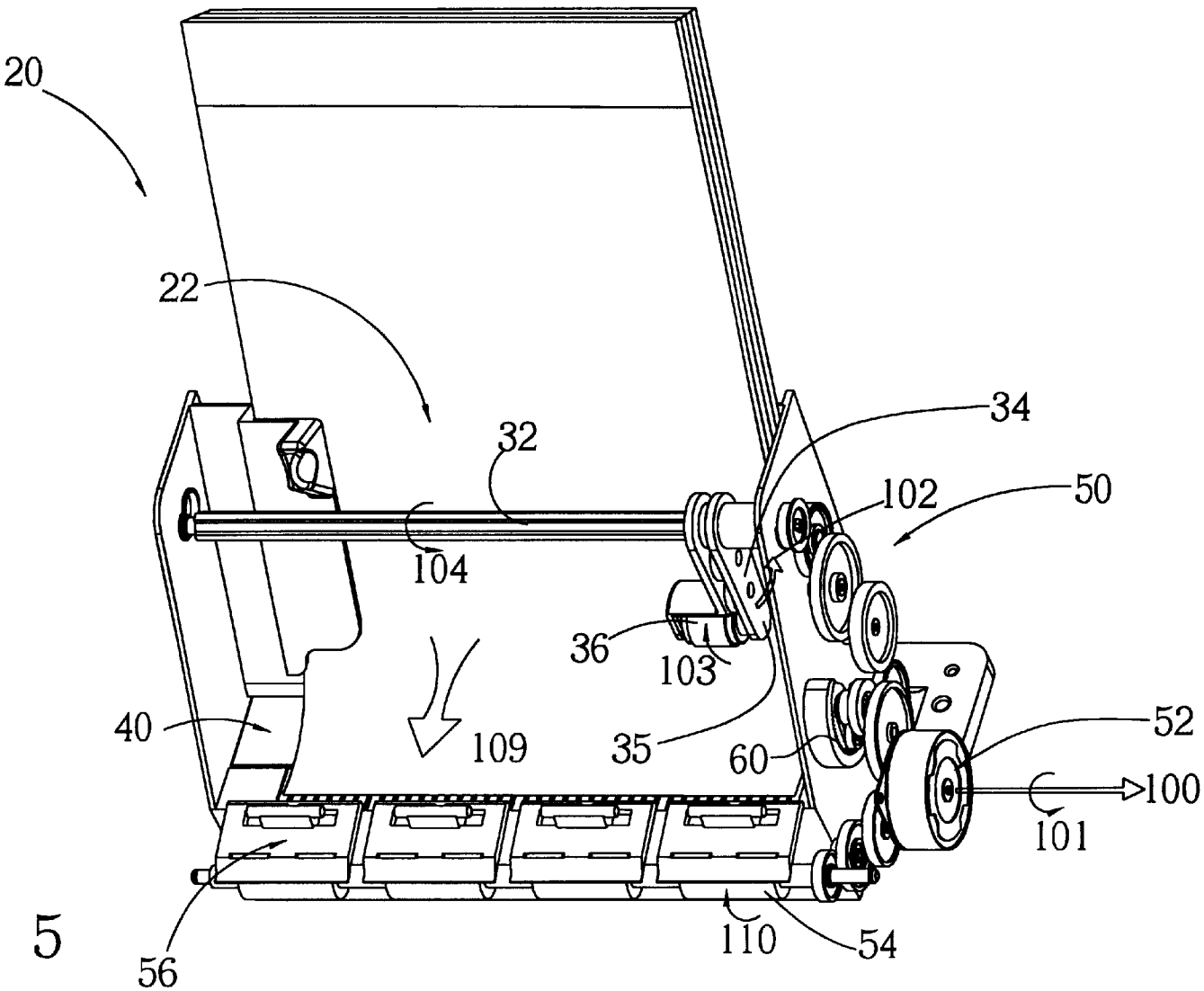
FIG. 5 is a perspective view of the media feeding system of FIG. 2 beginning to feed media.

Please refer back to FIG. 2. The media restrainer 40 is normally in either an up position or a down position, and is rotatably mounted just after the media tray 22. In FIG. 2, the media restrainer 40 is shown in the up position. When in the up position, media in the media tray 22 is prevented from sliding forward towards the feed roller 54. When in the down position, the media restrainer 40 permits media to move forward towards the feed roller 54. By operating in the first driving direction, the motor 52 causes the drive train 50 to rotate the media restrainer 40 into the down position, as shown in FIG. 5. By operating in the second driving direction, the motor 52 causes the drive train 50 to rotate the media restrainer 40 into the up position, as shown in FIG. 4. Consequently, when the motor 52 operates in the second driving direction and causes the pick roller 36 to swing away from the media in the media tray 22, the media restrainer 40 is also placed into the up position, thus preventing any media from slipping forward towards the feed roller 54. Conversely, the media restrainer 40 rotates into the down position when the motor 52 operates in the first driving direction, and thus permits the pick roller 36 to push a sheet of media forward past the media restrainer 40 towards the feed roller 54.

Figure 7A:
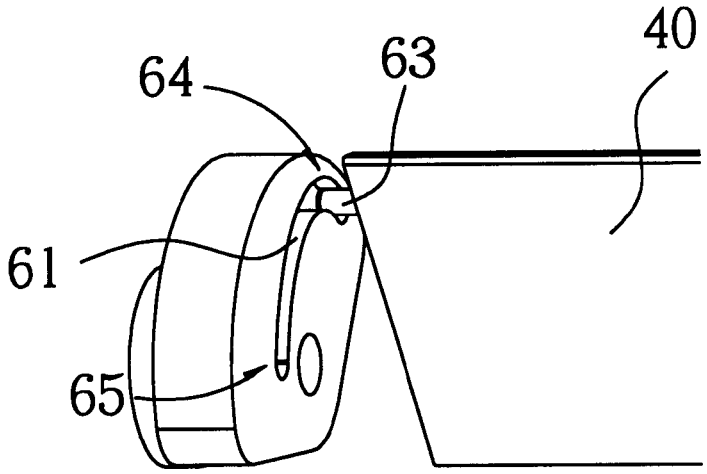
FIGS. 7*a* and 7*b* are perspective views of an incomplete internal gear that has a curved sliding slot.
Figure 7B:
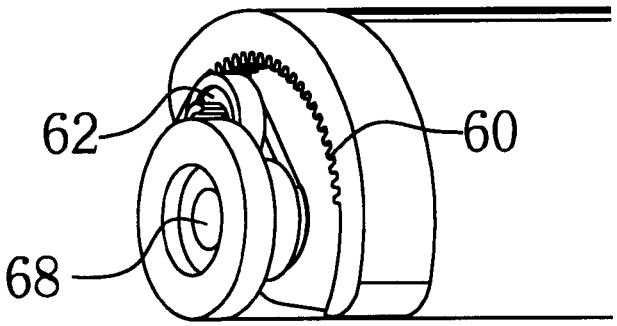

Please refer to FIGS. 7*a* and 7*b*. To avoid seizing of the drive train 50 when the media restrainer 40 reaches its swing limits of fully up or fully down, another torque limiter is provided. In this embodiment, an incomplete internal gear 60 is provided and installed between the drive train 50 and the media restrainer 40 to serve this function. The incomplete internal gear 60 has a curved sliding slot 61. When the media restrainer 40 reaches the fully up position, the swing gear 62 will move to the incomplete teeth of the incomplete internal gear 60, and the pin 63 of the media restrainer 40 will slide to the first pole 64 of the curved sliding slot 61; when the media restrainer 40 reaches the fully down position, the swing gear 62 will move to the incomplete teeth of the incomplete internal gear 60, and the pin 63 of the media restrainer 40 will slide to the second pole 65 of the curved sliding slot 61. The position of the first pole 64 and the second pole 65 should be well arranged, so that when the media restrainer 40 reaches the fully up position or the fully down position the weight of the media restrainer 40 itself will not cause the pin 63 of the media restrainer 40 to slide along the curved sliding slot 61. To reach this goal, in this preferred embodiment, the curvature center of the curved sliding slot 61 is the pivot 68 of the incomplete internal gear 60. In this way, the torque caused by the weight of the media restrainer 40 equals to zero, so the pin 63 of the media restrainer 40 will not slide along the curved sliding slot 61 when the media restrainer 40 reaches the first pole 64 or the second pole 65.

The media separator 45 is installed on the media restrainer 40, and is a contact pad with a high coefficient of friction. The media separator 45 is used to ensure that only a single sheet of media is pushed forward towards the feed roller 54. When two sheets of a media attempt to pass the media separator 45, the bottom sheet will be held by the contact pad of the media separator 45 due to the relatively high amount of friction between the sheet and the contact pad. Consequently, the top sheet of media will continue forward, sliding over the bottom sheet, on to the feed roller 54. Once the top sheet has moved forward, the bottom sheet will be pushed back to a proper position by the media restrainer 40 when the media restrainer 40 reaches the up position, and the bottom sheet will be the next sheet pushed forward by the pick roller 36 when the media restrainer 40 reaches the down position again.

Initially, the media feeding system 20 is in a state where the pick arm 34 is rotated so that the pick roller 36 is not in contact with media in the media tray 22. Similarly, the media restrainer 40 is in the up position, and thus prevents media from slipping forward towards the feed roller 54. In this configuration it is easy for a user to load new media, such as thin paper, into the media tray 22. Since the pick roller 36 is up, and thus is not obstructing the loading path of the media, the media can be easily slid into the media tray 22.

Please refer to FIG. 5. FIG. 5 is a perspective view of the media feeding system 20 beginning to feed media. To initiate a media feeding sequence, a controlling circuit (not shown), electrically connected to the motor 52, causes the motor to begin operating in the first driving direction 101. As described above, this causes the pick shaft 32 to rotate in the direction 104, rotating the pick pivot 35 in the direction 102 and bringing the pick roller 36 into contact with the stacked media in the media tray 22. The direction 104 of the pick shaft 32 also causes the pick roller 36 to rotate in the direction 103, causing the pick roller 36 to push at least one top sheet of media forward out of the media tray 22, as shown by arrow 109. At the same time, the drive train 50 causes the media restrainer 40 to rotate into the down position, thus permitting the sheet, or sheets, of media to move in the forward direction 109 towards the feed roller 54. The media separator 45 (not visible in FIG. 5) ensures that only the top sheet progresses past the media restrainer 40.

As shown in FIG. 5, the feed roller 54 rotates in a direction 110 that is contrary to the forward moving direction 109 of the sheet of media as it is pushed by the pick roller 36 for aligning the leading edge of the sheet of media. That is, the drive train 50 spins the feed roller 54 in a direction that is contrary to the media-moving direction of the pick roller 36 so that the leading edge of the sheet of media is adjusted. A media sensor (not shown), is installed between the media separator 45 and the feed roller 54. Ideally, the media sensor is installed under media guides 56, which direct a leading edge of the sheet of media towards the feed roller 54. The media sensor is electrically connected to the controlling circuit. When it senses the leading edge of the sheet of media, it sends a sensing signal to the controlling circuit. After waiting a predetermined period of time, the controlling circuit changes the driving direction of the motor 52 from the first driving direction 101 to the second driving direction 105 (shown in FIG. 4).

When the controlling circuit reverses the driving direction of the motor 52 to the second driving direction 105, the leading edge of the sheet of media should be in contact with the feed roller 54. In fact, just prior to the reversal of the driving direction of the motor 52, there may be some bowing of the sheet of media as it is temporarily caught between the contrarily moving directions of the pick roller 36 and the feed roller 54 so that the leading edge of the sheet of media is adjusted and aligned.

Figure 6:
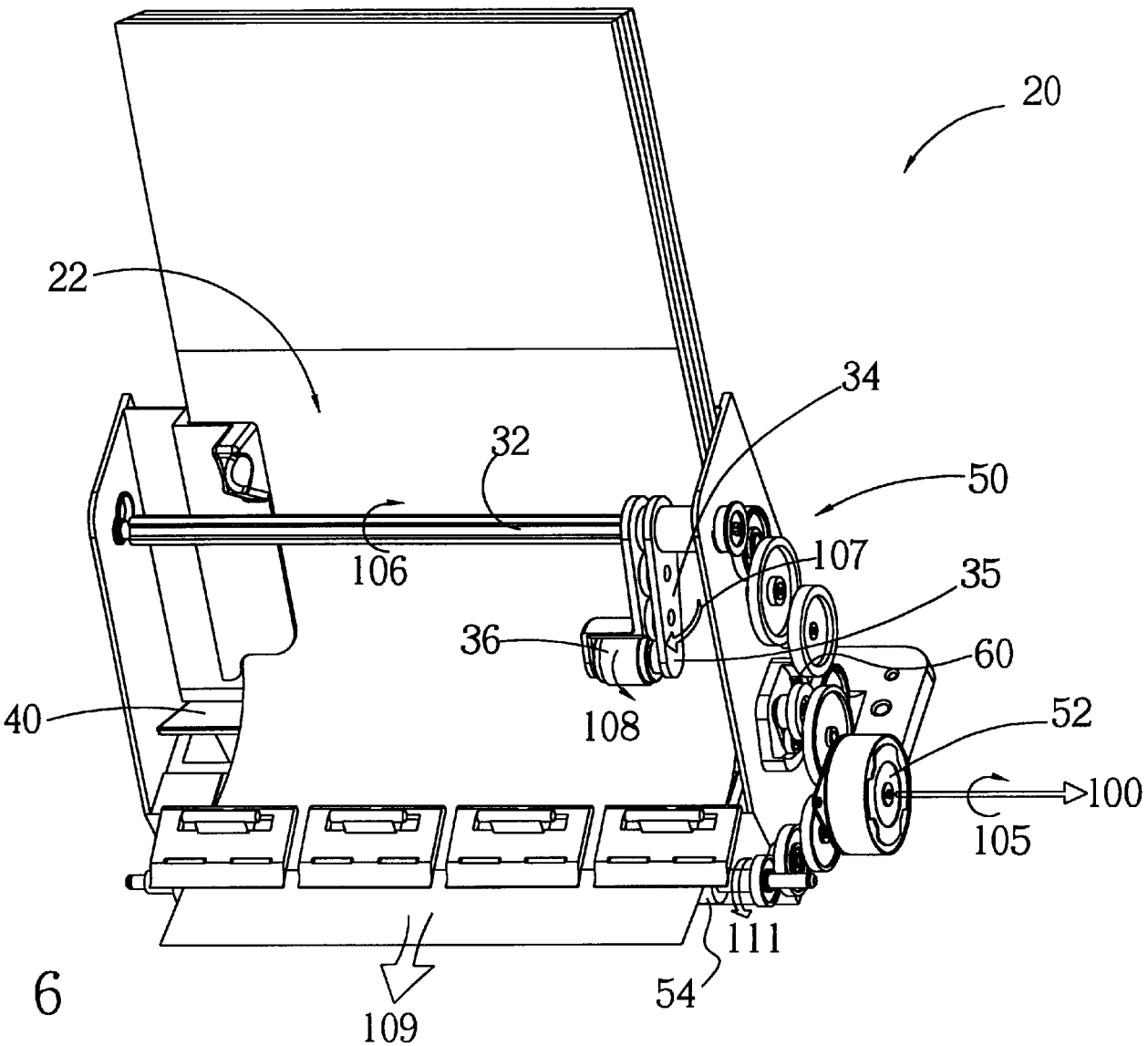
FIG. 6 is a perspective view of the media feeding system of FIG. 2 in a second phase of media feeding.

Please refer to FIG. 6. FIG. 6 is a perspective view of the media feeding system 20 in a second phase of media feeding. The controlling circuit (not shown) causes the motor 52 to operate in the second driving direction 105, causing the pick shaft 32 to rotate in the direction 106. This rotates the pick pivot 35 in the direction 107, lifting the pick roller 36 away from the stacked media. Consequently, the rotational direction 108 of the pick roller 36 is not able to interfere with the feeding operation of the feed roller 54, which now rotates in direction 111, and continues to push the sheet in the forward direction 109. Also, the media restrainer 40 is rotated into the up position by the drive train 50, and thus prevents the remaining media in the media tray 22 from sliding in the forward direction 109 towards the feed roller 54. After the media sensor (not shown) senses that the trailing edge of the sheet has passed, the controlling circuit can wait another predetermined period of time before it turns the motor 52 off. The media feeding system 20 is then back in its original state, and can again be easily loaded with new media. In this preferred embodiment the motor 52 changes its driving direction to alter the operation of the pick arm 34, the pick roller 36, and the media restrainer 40. It is also possible to use other mechanisms for altering the operation of the pick arm 34, the pick roller 36, and the media restrainer 40. For example, in another embodiment we may use a differently designed drive train which is capable of switching between two different states so that the operation of the pick arm 34, the pick roller 36, and the media restrainer 40 can be altered while the driving direction of the motor 52 is kept unchanged. Such an embodiment can be easily developed by a person skilled in the art after reading the above description, and thus will not be described in detail. Such ramification or the like should also be included in the scope of the present invention.

It should be noted that the above disclosure is for a preferred embodiment of the present invention, and should not be construed as the only possible embodiment, or as a limitation of the present invention. For example, the exact configuration of the driving train 50 could be changed, as regards the type and number of gears, or even if gears are to be used at all. The same, of course, is true for the pick arm assembly. Similarly, the location of elements, such as the media separator, may be changed, leaving the key features of the invention intact.

In contrast to the prior art, the present invention utilizes a rotating pick arm and a rotating media restrainer. The rotating pick arm permits easy loading of even flimsy media into the media tray of the present invention media feeding system, as it is raised off of the media except when performing a feeding operation. The media restrainer rotates into an up position when the media feeding system is not performing a feeding operation, and thus prevents media from slipping forward into the feed rollers when the pick arm is raised. The media restrainer rotates into the down position when a feeding operation is being performed, thus permitting a sheet of media to move forward towards the feed roller.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A media feeding system for delivering media from a media tray to a medium processing apparatus, comprising:

a pick arm having a rotation pivot and a pick pivot, the rotation pivot rotatably mounted over the media tray, the pick pivot capable of rotating about the rotation pivot;

a pick roller rotatably mounted on the pick pivot of the pick arm;

a motor having a first driving direction and a second driving direction; and a drive train for providing torque from the motor to the pick arm and to the pick roller;

wherein when the motor operates in the first driving direction, the drive train causes the pick arm to rotate down, bringing the pick roller into contact with the media, and the pick roller rotates and pushes at least a sheet of the media in a forward direction; when the motor operates in the second driving direction, the drive train causes the pick arm to rotate up so that the pick roller does not contact the media.

2. The media feeding system of claim 1 further comprising a first torque limiter installed between the rotation pivot of the pick arm and the drive train; wherein the first torque limiter ensures that the motor can continue to drive the drive train when the pick arm reaches a swing limit.

3. The media feeding system of claim 2 further comprising a pick shaft rotatably mounted above the media tray, the drive train providing torque from the motor to the pick shaft; wherein the rotation pivot of the pick arm is mounted on the pick shaft using the first torque limiter, rotation of the pick shaft causing the pick arm to rotate up or to rotate down according to the driving direction of the motor.

4. The media feeding system of claim 3 further comprising a pick arm assembly for providing torque from the pick shaft to the pick roller.

5. The media feeding system of claim 1 further comprising a media restrainer movably mounted after the media tray in the forward direction, the media restrainer being able to move to an up position or a down position, the drive train providing torque to the media restrainer from the motor; wherein when the motor operates in the first driving direction, the drive train causes the media restrainer to move to the down position, permitting the pick roller to push at least a sheet from the media tray into the forward direction past the media restrainer; when the motor operates in the second driving direction, the drive train causes the media restrainer to move to the up position so that the stacked media cannot slide in the forward direction.

6. The media feeding system of claim 5 further comprising a second torque limiter installed between the media restrainer and the drive train; wherein the second torque limiter ensures that the motor can continue to drive the drive train when the media restrainer has reached the up position or the down position.

7. The media feeding system of claim 5 further comprising a media separator installed after the pick roller in the forward direction; wherein the media separator ensures that the media feeding system feeds only a single sheet on in the forward direction.

8. The media feeding system of claim 7 wherein the media separator is a contact pad with a high coefficient of friction installed on the media restrainer so that a bottom sheet is stopped by the contact pad, and a top sheet slides forward over the bottom sheet.

9. The media feeding system of claim 5 further comprising a feed roller rotatably mounted after the media restrainer in the forward direction, the drive train providing torque to the feed roller from the motor; wherein when the motor operates in the first driving direction, the pick roller pushes a sheet forward from the media tray past the media restrainer to the feed roller.

10. The media feeding system of claim 9 further comprising a sheet sensor installed before the feed roller in the forward direction; wherein, when the sheet sensor senses a sheet, the sheet sensor will cause the motor to operate in the second driving direction after a predetermined period of time, and the feed roller will then continue to move the sheet along in the forward direction.

11. A media feeding system for delivering media from a media tray to a medium processing apparatus, comprising:

a pick arm having a pick roller rotatably mounted on a pick pivot of the pick arm, the pick roller being used to push at least a sheet of the media in a forward direction out of the media tray;

a media restrainer mounted after the media tray in the forward direction, the media restrainer being able to move to an up position or a down position;

a motor having a first driving direction and a second driving direction; and a drive train for providing torque from the motor to the pick roller and to the media restrainer;

wherein when the motor operates in the first driving direction, the drive train causes the media restrainer to move to the down position, and the pick roller is then able to push at least a sheet from the media tray into the forward direction past the media restrainer; when the motor operates in the second driving direction, the drive train causes the media restrainer to move to the up position so that the media cannot move in the forward direction past the media restrainer.

12. The media feeding system of claim 11 wherein the pick arm has a rotation pivot, the rotation pivot being rotatably mounted over the media tray, the pick arm rotating around the rotation pivot on the pick arm according to the driving direction of the motor, and the drive train provide torque to the pick arm from the motor; wherein when the motor operates in the first driving direction, the drive train causing the pick arm to rotate down, bringing the pick roller into contact with the stacked media, and the pick roller then pushes at least a sheet from the media tray into the forward direction past the media restrainer; when the motor operates in the second driving direction, the drive train causes the pick arm to rotate up so that the pick roller does not contact the stacked media.

13. The media feeding system of claim 12 further comprising a torque limiter installed between the rotation pivot of the pick arm and the drive train; wherein the torque limiter ensures that the motor can continue to drive the drive train when the pick arm reaches a swing limit.

14. The media feeding system of claim 11 further comprising a second torque limiter installed between the media restrainer and the drive train; wherein the second torque limiter ensures that the motor can continue to drive the drive train when the media restrainer reaches the up position or the down position.

15. The media feeding system of claim 13 further comprising a pick shaft rotatably mounted above the media tray, the drive train providing torque to the pick shaft from the motor; wherein the rotation pivot of the pick arm is mounted on the pick shaft using the first torque limiter, the rotation of the pick shaft causing the pick arm to rotate up or to rotate down, the pick shaft providing torque to drive the pick roller.

16. The media feeding system of claim 11 further comprising a media separator installed after the pick roller in the forward direction; wherein the media separator ensures that the media feeding system feeds only a single sheet on in the forward direction.

17. The media feeding system of claim 16 wherein the media separator is a contact pad with a high coefficient of friction installed on the media restrainer so that a bottom sheet is stopped by the contact pad, and a top sheet slides forward over the bottom sheet.

18. The media feeding system of claim 11 further compricing a feed roller rotatably mounted after the media restrainer in the forward direction, the drive train providing torque to the feed roller from the motor; where in when the motor operates in the first driving direction, the pick roller pushes a sheet forward from the media tray past the media restrainer to the feed roller.

19. The media feeding system of claim 18 further comprising a sheet sensor installed before the feed roller in the forward direction; wherein, when the sheet sensor senses a sheet, the sheet sensor will cause the motor to operate in the second driving direction after a predetermined period of time, and the feed roller will then continue to move the sheet along in the forward direction.

20. A media feeding system for delivering media from a media tray to a media processing apparatus, the media feeding system comprising:

a pick arm having a rotation pivot and a pick pivot, the rotation pivot rotatably mounted over the media tray, the pick pivot capable of rotating about the rotation pivot;

a pick roller rotatably mounted on the pick pivot of the pick arm;

a media restrainer mounted after the media tray in the forward direction, the media restrainer being able to move to an up position or a down position; and a driving mechanism for driving the pick arm, the pick roller, and the media restrainer;

wherein when the media feeding system delivers the media from the media tray to the media processing apparatus, the driving mechanism first causes the pick arm to rotate down, bringing the pick roller into contact with the media, causes the media restrainer to move to the down position, permitting the pick roller to rotate and push the media in a forward direction; then the driving mechanism causes the pick arm to rotate up so that the pick roller does not contact the media and the media restrainer moves to an up position so that media remaining in the media tray cannot slide in the forward direction.

* * * * *